US005932407A

United States Patent [19]

Begley et al.

[11] Patent Number: 5,932,407

[45] Date of Patent: Aug. 3, 1999

[54] COLOR PHOTOGRAPHIC ELEMENT CONTAINING OXIDIZED DEVELOPER-SCAVENGING NAPHTHOLIC COUPLER FORMING WASH-OUT DYE

[75] Inventors: William J. Begley, Webster; Stephen P. Singer, Spencerport; Allan F. Sowinski, Rochester, all of N.Y.

[73] Assignee: Eastman Kodak Company, Rochester, N.Y.

[21] Appl. No.: 08/846,910

[22] Filed: Apr. 30, 1997

[51] Int. Cl.[6] ..... G03C 7/305; G03C 7/32

[52] U.S. Cl. ..... 430/544; 430/553; 430/955; 430/957

[58] Field of Search ..... 430/544, 553, 430/955, 957

[56] References Cited

U.S. PATENT DOCUMENTS

| | | | |
|---|---|---|---|
| 4,477,560 | 10/1984 | Koitabashi et al. | 430/506 |
| 5,084,373 | 1/1992 | Watanabe et al. | 430/496 |
| 5,128,237 | 7/1992 | Kimura et al. | 430/378 |
| 5,151,343 | 9/1992 | Begley et al. | 430/382 |
| 5,254,582 | 10/1993 | Boder et al. | 514/469 |
| 5,264,582 | 11/1993 | Begley et al. | 518/253 |
| 5,264,583 | 11/1993 | Begley et al. | 430/382 |
| 5,283,340 | 2/1994 | Begley et al. | 548/144 |
| 5,286,859 | 2/1994 | Begley et al. | 544/140 |
| 5,300,406 | 4/1994 | Begley et al. | 430/382 |
| 5,358,828 | 10/1994 | Begley et al. | 430/385 |

FOREIGN PATENT DOCUMENTS

| | | | |
|---|---|---|---|
| 0284099 | 3/1988 | European Pat. Off. | G03C 7/32 |
| 0322904 | 12/1988 | European Pat. Off. | G03C 7/32 |
| 0383637 | 2/1990 | European Pat. Off. | G03C 7/30 |
| 443 530 | 8/1991 | European Pat. Off. | G03C 7/305 |
| J6 1084646 | 10/1984 | Japan . | |
| J6 1086751 | 10/1984 | Japan . | |
| 63-110451 | 5/1988 | Japan . | |
| JO 3160442 | 11/1989 | Japan . | |
| JO 2184848 | 12/1989 | Japan . | |

OTHER PUBLICATIONS

Research Disclosure 37038, Feb. 1995.

*Primary Examiner*—Mark F. Huff
*Attorney, Agent, or Firm*—Sarah Meeks Roberts

[57] ABSTRACT

A color photographic element comprising a film support and a first radiation-sensitive layer further includes an oxidized developer-scavenging naphtholic coupler that is substantially immobilized in the element but forms a dye that can be removed from the material during photographic processing. The naphtholic coupler, which comprises a dye-forming moiety and a ballasted, substantially photographically inert coupling-off moiety, has the structure where $R^1$ and $R^2$ each independently represents hydrogen, an alkyl group, an alkoxyalkyl group, or a hydroxyalkyl group, $R^1$ and $R^2$ together containing a total of up to 4 carbon atoms; $R^3$ represents hydrogen, halo, or an alkoxy, an alkylcarbonamido, an alkylsulfonamido, a carbamoyl, or a sulfamoyl group containing up to 4 carbon atoms; $R^1$, $R^2$, and $R^3$ of the dye-forming moiety are each devoid of alkali-solubilizing groups and together allow substantially complete removal during photographic processing of the dye formed by the naphtholic coupler; $R^4$, $R^5$ and $R^6$ represent substituent groups that together comprise ballast sufficient to substantially immobilize the coupler in the color photographic element and together render the coupling-off moiety substantially photographically inert, at least one of $R^4$, $R^5$ and $R^6$ comprises at least 8 carbon atoms; and $R^5$ is selected from a group of substituent groups effective to substantially prevent formation of dye and/or stain by reaction of the coupling-off moiety with oxidized developer.

24 Claims, No Drawings

COLOR PHOTOGRAPHIC ELEMENT CONTAINING OXIDIZED DEVELOPER-SCAVENGING NAPHTHOLIC COUPLER FORMING WASH-OUT DYE

FIELD OF THE INVENTION

This invention relates to color photographic materials and, more particularly, to color photographic elements containing naphtholic couplers that scavenge oxidized developer and form dyes that can be removed from the photographic materials during processing.

BACKGROUND OF THE INVENTION

Scavengers for oxidized developing agents are frequently included in a color photographic element to prevent a color-forming reaction of the oxidized developer at an undesired location within the element. For example, it is generally undesirable for an oxidized developer species to diffuse away from the color-forming imaging layer where it was generated to another imaging layer, where it forms undesired dye of another color. This undesirable effect can be prevented or mitigated by ballasted developer scavenger compounds incorporated in an interlayer between two color-forming imaging layers.

In addition to this just mentioned use in interlayers to prevent color contamination, oxidized developer scavengers may also be employed within a color-forming imaging layer to control color fog and adjust the tone scale of a dye image.

Oxidized developer-scavenging compounds are typically ballasted to enable their incorporation in a particular layer within a photographic element while preventing their diffusion from that layer during coating and subsequent keeping and processing. The most commonly employed scavengers are ballasted polyfunctionalized aromatic compounds containing multiple hydroxy, amino, and sulfonamido groups, and combinations thereof, for example, hydroquinones, catechols, pyrogallols, sulfonamidophenols, aminophenols, disulfonamidophenols, aminosulfonamidophenols, and the like. In general, unless at least one of these functional groups is protected by a blocking group removable during processing or other masking means, a scavenger incorporated in a photographic element may exhibit photographic reactivity, usually with undesirable results, prior to color development processing. This is especially likely with polyhydroxysubstituted scavenger compounds containing two or more unprotected hydroxy groups.

Various coupler compounds that release oxidized developer scavenging moieties have been disclosed in the art. For example, U.S. Pat. No. 5,084,373 discloses photographic elements containing couplers that comprise various yellow, magenta, and cyan dye-forming moieties, mostly ballasted but a few unballasted and carboxy-solubilized, and coupling-off moieties that are scavengers for oxidized developer. Similar coupler compounds are disclosed in EP 0383637.

U.S. Pat. No. 4,477,560 discloses methylenebis coupler compounds, each comprising a ballasted and an unballasted dye-forming moiety. U.S. Pat. No. 5,128,237 discloses a direct positive photographic material that contains couplers having ballasted dye forming moieties and oxidized developer scavengers or scavenger precursor coupling-off moieties.

EP 0284099 discloses compounds that are purported to be anti-color staining and anti-color fogging and have unballasted dye-forming moieties substituted with various alkali solubilizing groups, preferably carboxy, and coupling-off moieties is that are ballasted reducing agents. EP 0322904 discloses couplers containing ballasted dye-forming moieties and aryloxy coupling-off groups that include —$NHSO_2NR_1R_2$ substituents.

JP 63-110451 discloses couplers containing naphtholic or phenolic dye-forming moieties with carboxy solubilizing substituents and ballasted 2,4-disulfonamido coupling-off groups.

Couplers releasing scavengers for oxidized developer are also described in J6 1084646, J6 1086751, JO 3160442, and JO 2184848.

The disclosures of the eleven references just described are incorporated herein by reference.

Also well known in the art are dye-forming coupler compounds whose structures include diffusion-preventing ballast groups to enable their incorporation in a particular location within a photographic element but which produce dyes that are eliminated from the element in the course of processing. Such couplers are usually referred to as "wash-out couplers," regardless of the actual dye elimination mechanism, for example, diffusion, decomposition, decolorization, and the like.

Naphtholic wash-out couplers that release various photographically useful groups (PUGs) during processing, methods for making them, and photographic materials containing them are described in, for example, U.S. Pat. Nos. 5,151,343, 5,264,583, and 5,283,340, the disclosures of which are incorporated herein by reference. U.S. Pat. Nos. 5,286,859 and 5,358,828, the disclosures of which are incorporated herein by reference, describe wash-out couplers whose PUG coupling-off moieties comprise bleach accelerator releasing compounds (BARCs). Photographic elements comprising combinations of a bleach accelerator releasing compound (BARC) and a development-inhibitor releasing (DIR) coupler are described in U.S. Pat. No. 5,300,406, the disclosure of which is incorporated herein by reference.

As discussed above, coupler compounds that efficiently scavenge oxidized developer and form dyes removable from photographic elements during processing are very useful for improving the quality of color photographic images. There is an ongoing need for new, highly active, oxidized developer-scavenging couplers that are readily synthesized and purified, are stable during long-term storage, and release coupling-off moieties that are photographically inert. The present invention meets these objectives.

SUMMARY OF THE INVENTION

In accordance with the present invention, a color photographic element comprising a substrate and a first radiation-sensitive layer further includes an oxidized developer-scavenging naphtholic coupler that is substantially immobilized in the element but forms by reaction with oxidized developer a dye that is removed from the material during photographic processing. The naphtholic coupler, which comprises a dye-forming moiety and a ballasted, substantially photographically inert coupling-off moiety, has the structure

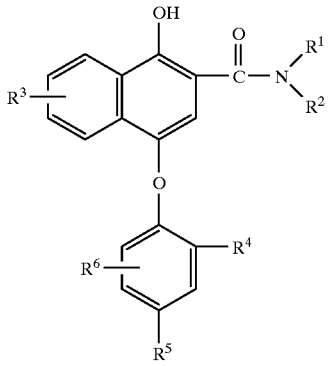

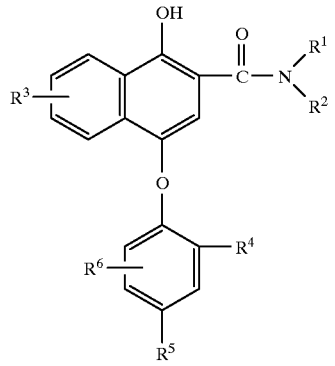

where $R^1$ and $R^2$ each independently represents hydrogen, an alkyl group, an alkoxyalkyl group, or a hydroxyalkyl group, $R^1$ and $R^2$ together containing a total of up to 4 carbon atoms; $R^3$ represents hydrogen, halo, an alkoxy group containing up to 4 carbon atoms, an alkylcarbonamido or alkylsulfonamido group containing up to 4 carbon atoms, or a carbamoyl or sulfamoyl group containing up to 4 carbon atoms; $R^1$, $R^2$, and $R^3$ of the dye-forming moiety are each devoid of alkali-solubilizing groups and together allow substantially complete removal during photographic processing of the dye formed by the naphtholic coupler; $R^4$, $R^5$, and $R^6$ represent substituent groups that together comprise ballast sufficient to substantially immobilize the naphtholic coupler in the color photographic element and together render the coupling-off moiety substantially photographically inert; at least one of $R^4$, $R^5$, and $R^6$ comprises at least 8 carbon atoms; and $R^5$ is selected from a group of substituent groups effective to substantially prevent formation of dye and/or stain by reaction of the coupling-off moiety with oxidized developer.

In one embodiment of the invention, the naphtholic coupler is included in the first radiation-sensitive layer, which preferably also includes a coupler compound capable of forming a dye that remains in the first radiation-sensitive layer following photographic processing. In a preferred further embodiment, the photographic element farther comprises a second radiation-sensitive layer that preferably includes a dye-forming coupler compound different from that in the first layer and, disposed between the radiation-sensitive layers, a radiation-insensitive interlayer that includes the oxidized developer-scavenging naphthol coupler.

The absence of alkali solubilizing groups in the highly active oxidized developer-scavenging naphtholic couplers included in the photographic element of the present invention substantially facilitates their synthesis and purification. In addition, the inclusion of coupling-off moieties whose structures preclude their photographic activity is beneficial for preventing the formation of contaminating dyes and stains in processed photographic elements.

DETAILED DESCRIPTION OF THE INVENTION

Oxidized developer-scavenging couplers incorporated in the photographic element of the invention comprise a dye-forming moiety joined to a coupling-off moiety and have the general structure where $R^1$–$R^6$ are as previously defined; $R^1$–$R^3$ contain no alkali solubilizing groups but together allow substantially complete removal of the dye during processing; and $R^4$–$R^6$ together rendering the coupling-off moiety substantially photographically inert and comprises sufficient ballast to substantially immobilize the coupler in the photographic element.

The substituent group $R^5$ can be any group that prevents the coupling-off moiety released during formation of the wash-out dye from the naphthol coupler from itself undergoing a dye-forming or other stain generating reaction with additional oxidized developer. $R^5$ is selected from the group consisting of an alkyl group that is branched or unbranched, substituted or unsubstituted, an aryl group that is substituted or unsubstituted, a carbamoyl group that is substituted or unsubstituted, a sulfamoyl group that is substituted or unsubstituted, an alkylcarbonyl or arylcarbonyl group, an alkylsulfonyl or arylsulfonyl group, an alkylcarbonamido or arylcarbonamido group, an alkoxy carbonyl or aryloxycarbonyl group and a ureido group that is substituted or unsubstituted. Preferably, $R^5$ is an alkyl group, a carbamoyl group, or a sulfamoyl group.

Substituent groups $R^4$ and $R^6$ are independently selected from any of the groups named for $R^5$ as well as from the group consisting of hydrogen, a halo substituent such as fluoro, chloro, bromo, and iodo, a cyano group, an alkoxy or aryloxy group, an alkylthio or arylthio group, and an alkylsulfonamido or arylsulfonamido group, with the proviso that only one of $R^4$ and $R^6$ can be an alkylsulfonamido or arylsulfonamido group having hydrogen attached to the sulfonamide nitrogen atom. This proviso is included to avoid the possible imparting of photographic activity to the coupling-off moiety, which may occur if both $R^4$ and $R^6$ were alkylsulfonamido or arylsulfonamido groups that each included a hydrogen-substituted sulfonamide nitrogen atom. For the same reason, i.e., avoidance of photographic activity from the coupling-off moiety, hydroxy and amino groups are not contemplated as $R^4$ or $R^6$ substituents. As already noted, $R^4$ and $R^6$, together with $R^5$, substantially immobilize the developer-scavenging coupler and render the coupling-off moiety substantially photographically inert.

In preferred embodiments of the invention, $R^1$ of the dye-forming moiety is hydrogen, and $R^2$ is hydrogen, methyl, ethyl, hydroxyethyl, methoxyethyl, and ethoxyethyl. In a more preferred embodiment, $R^1$, $R^2$, and $R^3$ are each hydrogen.

In other preferred embodiments of the invention, $R^4$ of the coupling-off moiety is an alkylsulfonamido group, an arylsulfonamido group, an alkylcarbonamido group, or an arylcarbonamido group that comprises ballast sufficient to substantially immobilize the coupler in the photographic element. In especially preferred embodiments, $R^4$ is a hexadecanesulfonamido group or a p-dodecyloxybenzenesulfonamido group.

In an especially preferred embodiment, $R^6$ is hydrogen, $R^5$ is a hydroxymethyl group, and $R^4$ is an alkylsulfonamido group, an arylsulfonamido group, an alkylcarbonamido group, or an arylcarbonamido group that comprises ballast sufficient to substantially immobilize the coupler in the photographic element.

Unless otherwise specifically stated, when a substituent group contains a substitutable hydrogen, it is intended to encompass not only the substituent's unsubstituted form, but also its form further substituted with any group or groups as herein mentioned, so long as the group does not destroy properties necessary for photographic utility Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 3-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, α-(2,4-di-t-pentyl-phenoxy)acetamido, α-(2,4-di-t-pentylphenoxy)butyramido, α-(3-pentadecylphenoxy)-hexanamido, α-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl[carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2-4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfinyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

Photographic couplers can be incorporated in photographic elements of the invention by means and processes known in the photographic art. In a photographic element, couplers should be of such size and configuration that they do not diffuse out of the layer in which they are incorporated during preparation or storage of the photographic element and do not, prior to exposure and processing, exhibit any photographic activity. High molecular weight hydrophobe or "ballast" groups may be included in coupler molecules to prevent or restrain their migration within the photographic element. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

A photographic element in which couplers of this invention are incorporated can be a simple element comprising a support and a single silver halide emulsion layer, or it can be a multilayer, multicolor element. The couplers can be incorporated in at least one of the silver halide emulsion layers and/or in at least one other layer, for example, an adjacent layer where they come into reactive association with oxidized color developing agent produced by silver halide development in an emulsion layer. The silver halide emulsion layer can contain, or have associated with it, other photographic coupler compounds such as, for example, dye-forming couplers, color masking couplers, competing couplers, development inhibitor releasing couplers, and bleach accelerator releasing couplers.

These other photographic couplers can form dyes of the same or different color or hue as the couplers of this invention. Additionally, the silver halide emulsion layers and other layers of the photographic element can contain addenda conventionally contained in such layers.

A typical multilayer, multicolor photographic element can comprise a support having thereon a red-sensitive silver halide emulsion unit having associated therewith a cyan dye image-providing compound, a green-sensitive silver halide emulsion unit having associated therewith a magenta dye image-providing compound, and a blue-sensitive silver halide emulsion unit having associated therewith a yellow dye image-providing compound, at least one of the silver halide emulsion units having associated therewith a photographic coupler of the invention. Each silver halide emulsion unit can be composed of one or more layers, and the various units and layers can be arranged in different locations with respect to one another.

The light-sensitive silver halide emulsions can include coarse, regular, or fine grain crystals of silver chloride, silver bromide, silver bromoiodide, silver chlorobromide, silver chloroiodide, silver chlorobromoiodide, or mixtures thereof. The emulsions can be negative-working or direct positive-working. They can form latent images predominantly on the surface of the silver halide grains or predominantly in the interior of the silver halide grains. They can be chemically and spectrally sensitized. The emulsions typically will be gelatin emulsions, although other hydrophilic colloids are useful. The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain light-sensitive silver halides such as those described in *Research Disclosure,* January 1983, Item Nos. 22534, and U.S. Pat. Nos. 4,434,226 and 5,164,292, the disclosures of which are incorporated herein by reference, are particularly useful.

Cyan dye image-providing compounds are couplers, preferably phenols or naphthols, that react with oxidized color developing agents to form cyan dyes. Magenta dye image-providing compounds are couplers that react with oxidized color developing agents to form magenta dyes and preferably are pyrazolone, pyrazolotriazole, or pyrazolobenzimidazole compounds. Yellow dye image providing compounds are couplers that react with oxidized color developing agents to form yellow dyes and preferably are acylacetamide compounds, more preferably benzoylacetanilides or pivaloylacetanilides.

The support can be any support typically used with photographic elements. Typical supports include cellulose nitrate film, cellulose acetate film, polyvinylacetal film, polyethylene terephthalate film, polyethylene naphthalate film, polycarbonate film, and related films, as well as glass, paper, metal, and the like. Typically, a flexible support is employed, for example, a polymeric film or a paper support that may be resin-coated.

In the following discussion of suitable materials for use in the emulsions and elements of this invention, reference will be made to *Research Disclosure,* December 1978, Item No. 17643, published by Industrial Opportunities Ltd., Homewell Havant, Hampshire P09 1EF, U.K., the disclosures of which are incorporated herein by reference. This publication will be identified hereafter by the term "Research Disclosure." Updated information on photographic silver halide emulsions, addenda, and other materials are included in *Research Disclosure* item 308119, December 1989; item 36544, September 1994; and item 38957, September 1996, the disclosures of which are incorporated herein by reference.

The photographic elements can be coated on a variety of supports, as described in Research Disclosure Section XVII and the references described therein.

Photographic elements can be exposed to actinic radiation typically in the visible region of the spectrum to form a latent image as described in Research a Disclosure Section XVIII, then processed to form a visible dye image as described is in Research Disclosure Section XIX. Processing to form a visible dye image includes the step of contacting the element with a color developing agent to reduce developable silver halide and oxidize the color developing agent. Oxidized developing agent in turn reacts with the coupler to yield a dye. Preferred color developing agents useful in the invention are p-phenylenediamines such as, for example, 4-amino-3-methyl-N-ethyl-N-(methanesulfonamido) ethylaniline and salts thereof. Development is followed by the conventional steps of bleaching, fixing, or bleach-fixing to remove silver and silver halide, then washing and drying.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41 process, as described in *The British Journal of Photography Annual,* 1988, pp. 191–198. If a color negative film element is to be subsequently employed to generate a viewable projection print as for a motion picture, a process such as the Kodak ECN-2 process, described in the H-24 Manual available from Eastman Kodak Co., may be employed to provide the color negative image on a transparent support. Color negative development times are typically 3' 15" or less and desirably 90 or even 60 seconds or less.

Another type of color negative element is a color print. Such an element is designed to receive an image optically printed from an image capture color negative element. A color print element may be provided on a reflective support for reflective viewing (e.g., a snap shot) or on a transparent support for projection viewing (e.g., a motion picture). Elements destined for color reflection prints are provided on a reflective support, typically paper, employ silver chloride emulsions, and may be optically printed using the so-called negative-positive process, where the element is exposed to light through a color negative film that has been processed as described above. The print may then be processed to form a positive reflection image using, for example, the Kodak RA-4 process as described in *The British Journal of Photography Annual,* 1988, pp. 198–199. Color projection prints may be processed, for example, in accordance with the Kodak ECP-2 process, as described in the H-24 Manual.

Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41), color print (Kodak RA-4), or reversal (Kodak E-6) process.

The following examples further illustrate the invention:

EXAMPLE 1

Synthesis of Coupler (1)

Coupler (1) was synthesized as shown in Scheme A below, following procedures included in the previously mentioned U.S. Pat. No. 5,264,583.

Scheme A

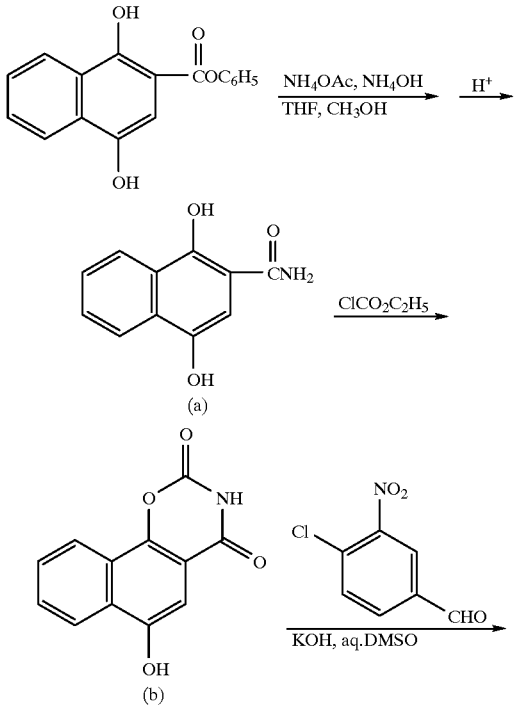

-continued

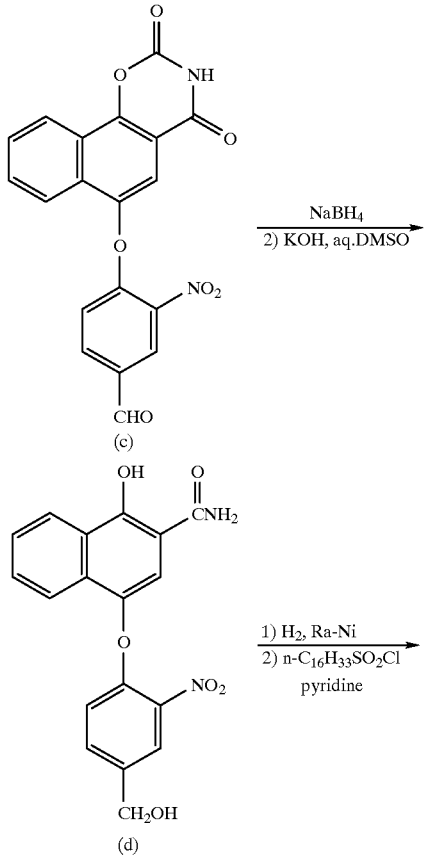

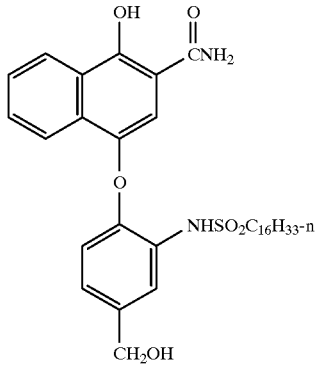

Phenyl 1,4-dihydroxy-2-naphthoate (100 g, 357 mMole) was dissolved in deoxygenated tetrahydrofuran, (500 mL), and deoxygenated methanol (500 mL) was added. To this solution, stirred at room temperature under a nitrogen atmosphere, was added ammonium acetate (50.0 g, 649 mMole), followed by concentrated ammonium hydroxide, (1.0 L). After stirring for 3 hours, the reaction solution was poured into ice cold 2N HCl (4.0 L), and enough concentrated HCl was added to bring the pH to 1. The resulting product, compound (a), was collected by filtration, washed well with water, air dried, washed with dichloromethane, and air dried again. Yield: 62.0 g, (72%).

Compound (a) (50.0 g, 0.246 mMole) was dissolved in dry pyridine (150 mL), and acetonitrile (75 mL) was added. The solution was stirred and cooled to 0 C. Ethyl chloroformate (50 mL, 0.52 mMole) was then added dropwise with stirring, while the temperature was maintained at 0 C. After the addition, the cooling bath was removed, and the temperature was allowed to rise to room temperature. The reaction mixture was then gradually heated to reflux and the solvent allowed to distill off. This procedure was continued until the temperature had risen to approximately 120 C. and 150 mL of solvent had been collected. Heating under reflux was continued for an additional 1 hour period. The reaction mixture was then cooled to approximately 50 C. and poured into 2N HCl (3.0 L) maintained at room temperature. The suspension was stirred for approximately 15 minutes, then filtered. The collected solid was washed well with water, acetonitrile, and finally ether. This gave the product, compound (b), sufficiently pure for the next step. Yield: 43.5 g (77%).

Compound (b) (23.0 g, 100.4 mMole) was taken up in deoxygenated dimethyl sulphoxide (250 mL), and deoxygenated water (25 mL) was added. To this solution, stirred at room temperature under nitrogen, was added 85% potassium hydroxide, (9.9 g, 151 mMole), and stirring was continued until dissolution, approximately 15 minutes. 4-Chloro-3-nitrobenzaldehyde (18.62 g, 100.4 mMole) was then added all at once, and the resulting solution was stirred at 60 C. for 1 hour. The reaction mixture was poured into ice cold 2N HCl (2.0 L) and filtered. The product, compound (c), was washed with ether and was pure enough to be used in the next step. Yield: 28.0 g (74%).

Compound (c) (28.0 g, 74.0 mMole), in a powdered form, was suspended in a mixture of tetrahydrofuran (150 mL) and methanol (100 mL). Water (100 mL) was added, followed by sodium borohydride (2.8 g, 74.0 mMole) in small portions. More tetrahydrofuran (50 mL) was added to aid stirring. At the end of the sodium borohydride addition complete dissolution had been achieved. The reaction was allowed to proceed for a further 15 minutes, then poured into ice cold 2N HCl (2.0 L). The product was collected by filtration, washed with methanol and, while still wet, suspended in ethanol. The mixture was heated to reflux, then cooled, and the solid that separated was washed with methanol, then ether, and finally air dried. A second crop of material was obtained on concentrating the mother liquor. Total yield of the benzyl alcohol precursor to compound (d): 19.5 g, (67%).

The latter material (19.0 g, 50 mMole) was suspended in water (200 mL) containing 85% potassium hydroxide (26.34 g, 400 mMole). To this mixture was added methanol (50 mL) and the resulting mixture was heated at 80 C. for 1 hour. The resulting dark yellow-brown solution was cooled and poured into ice cold 2N HCl (2.0 L). The yellow product was collected by filtration, washed well with water, and air dried. Yield of compound (d): 17.7 g (100%).

Compound (d) (17.7 g, 50 mMole) was dissolved in tetrahydrofuran (80 mL), and methanol (300 mL) was added. Raney-Nickel that had been washed several times with water and then with methanol was added, and the mixture was hydrogenated at 55 psi. Hydrogen uptake ceased after 2 hours. The catalyst was removed by filtration and washed with methanol, and the filtrate and washings were concentrated under reduced pressure to give the amino precursor to compound (1), which was deemed sufficiently pure to be carried on to the next step. Yield: 100%.

The above amino compound (50.0 mMole) was dissolved in dry pyridine (150 mL), and n-hexadecylsulphonyl chloride (16.2 g, 50.0 nMole) was added. The solution was stirred at room temperature under a nitrogen atmosphere for 30 minutes. The pyridine was removed under reduced pressure, and the residue was taken up in ethyl acetate. The ethyl acetate solution was washed three times with 2N HCl, dried over $MgSO_4$, filtered, and concentrated. The residue was crystallized from acetonitrile, and the solid obtained was washed with acetonitrile and dried to give 16.3 g (53% yield based on (d)) of compound (1).

Examples of additional developer scavenger-releasing couplers useful for the practice of the invention, which can be synthesized by analogous procedures, are depicted in TABLE 1 below.

TABLE 1

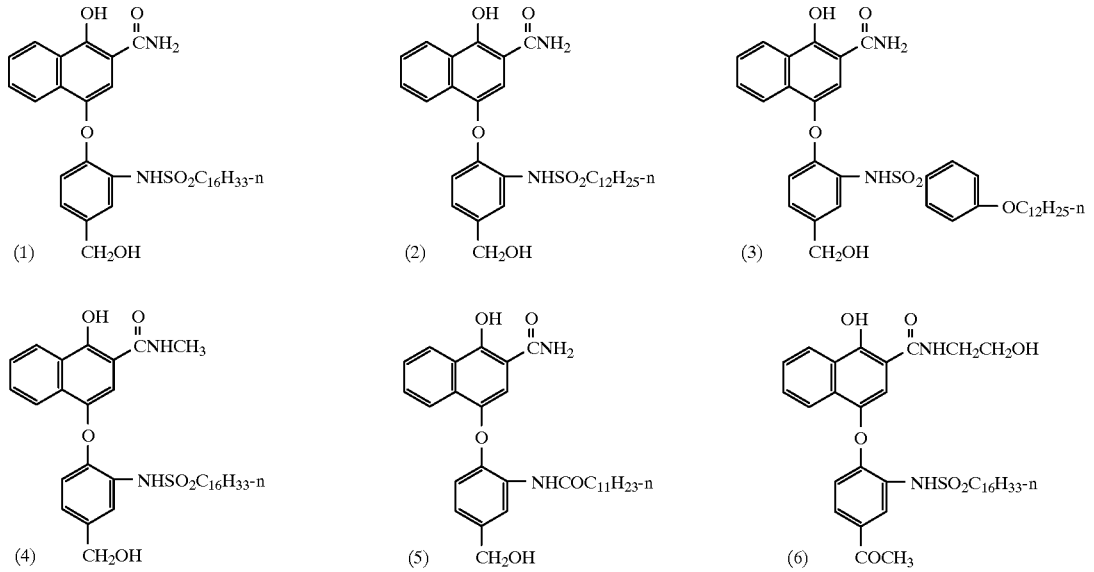

TABLE 1-continued

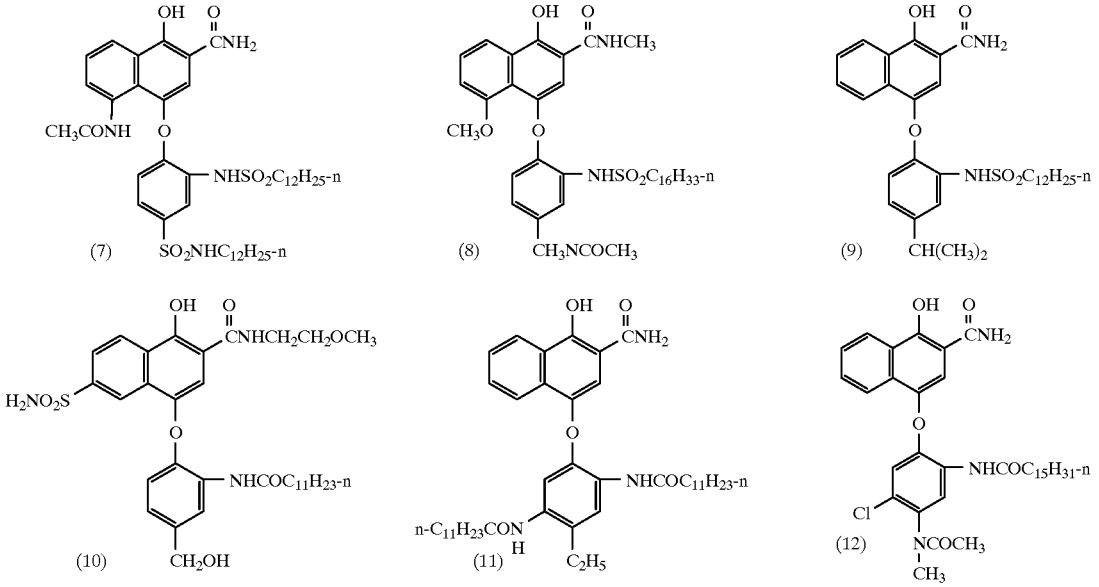

EXAMPLE 2

Photographic Testing of Oxidized Developer-scavenging Couplers

Multilayer photographic elements were prepared using a cellulose acetate-butyrate film support on which was coated an antihalation layer containing 4.89 g/m$^2$ of gelatin and 0.32 g/m$^2$ of colloidal silver. On the antihalation layer on the support were coated, in order, the following layers:

a photosensitive causer layer containing 2.42 g/m$^2$ of a tabular grain silver iodobromide emulsion sensitized with a mixture of the sensitizing dyes RSD-1 and RSD-2, 1.08 g/m$^2$ of yellow image dye-forming coupler Y-1, 0.325 g/m$^2$ of the antifoggant 5-methyl-s-triazolo[2,3a]pyrimidin-7-ol, and 2.15 g/m$^2$ of gelatin;

an interlayer containing 0.108 mole/m$^2$ of an oxidized developer-scavenging coupler of the invention or a control scavenger compound, each dispersed in N,N-dibutyllauramide at a 1:1 weight ratio, and 0.65 g/m$^2$ of gelatin;

a non-photosensitive receiver layer containing 0.33 g/m$^2$ of magenta image dye-forming coupler M-1 and 2.69 g/m$^2$ of gelatin; and an overcoat layer containing 5.4 g/m$^2$ of gelatin hardened with bis(vinylsulfonylmethyl) ether in an amount 1.75 weight percent of total gelatin.

RSD-1:

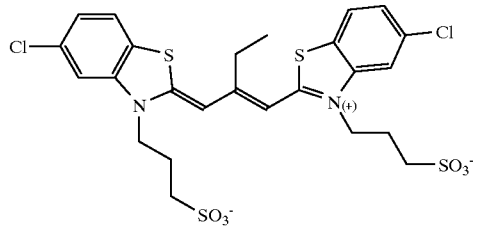

RSD-2:

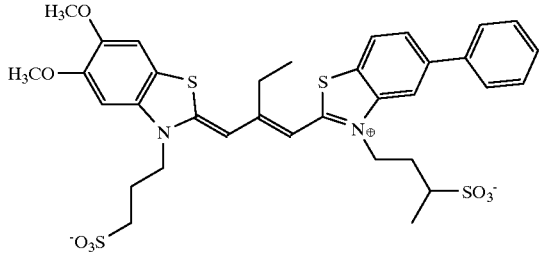

Y-1:

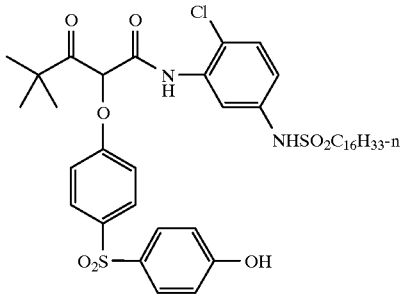

-continued

M-1:

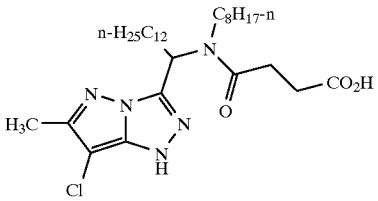

M-2:

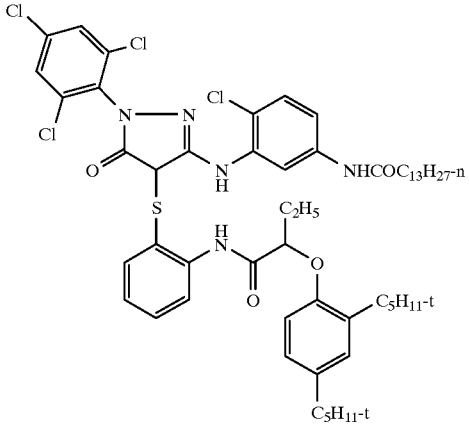

C-1:

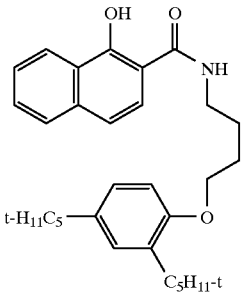

CS-1:

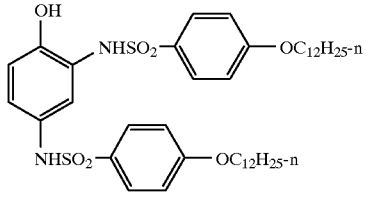

CS-2:

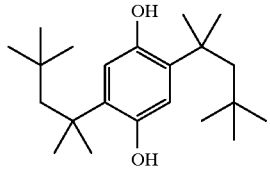

CS-3:

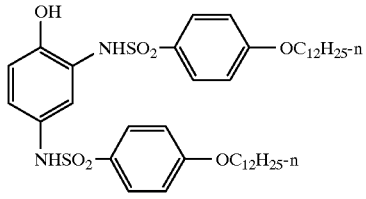

-continued

CS-4:

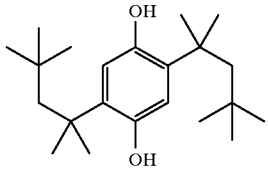

C-5:

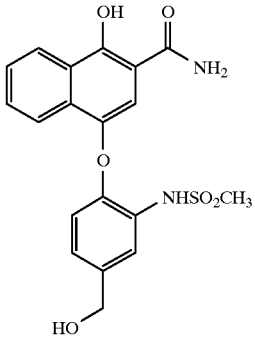

C-6:

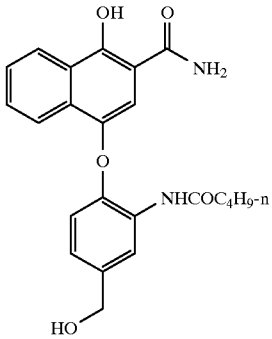

C-7:

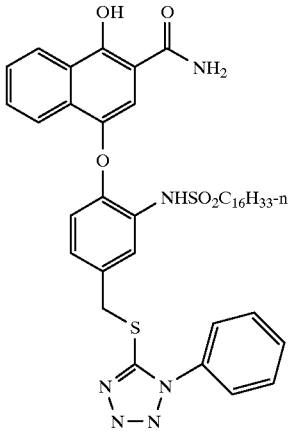

Samples of each of the photographic elements were exposed imagewise through a stepped density test object and subjected to KODAK FLEXICOLOR (C41) processing, as described in *British Journal of Photography Annual,* 1988, pp 196–198, using fresh unseasoned process solutions.

In the described format, magenta dye can be formed only by wandering of oxidized developer from the causer layer in which it is generated through the interlayer and into the receiver layer. The ability of the oxidized developer-scavenging coupler or control scavenger compound contained in the interlayer can be measured by the difference in green densities (G Delta) measured at maximum and minimum exposure (G D-max - G D-min). The amount of non-imagewise stain is determined by measuring red density at minimum exposure (R@E-min). The maximum red density at any point on the exposure scale (R D-max) is a composite of stain and density from a cyan dye image (where present) generated during processing.

Measurements from the processed photographic elements are summarized in TABLE 2 below:

TABLE 2

| Sample | Scavenger in Interlayer | G Delta | R @ E-min | R D-max |
|---|---|---|---|---|
| 2-1 Control | None | 0.429 | 0.273 | 0.281 |
| 2-2 Control | CS-1 | 0.216 | 0.331 | 0.336 |
| 2-3 Control | CS-2 | 0.362 | 0.291 | 0.295 |
| 2-4 Control | CS-3 | 0.322 | 0.378 | 0.482 |
| 2-5 Control | CS-4 | 0.309 | 0.424 | 0.508 |
| 2-6 Control | CS-5 | 0.390 | 0.307 | 0.311 |
| 2-7 Control | CS-6 | 0.385 | 0.305 | 0.308 |
| 2-8 Invention | (1) | 0.249 | 0.313 | 0.317 |
| 2-9 Invention | (2) | 0.320 | 0.311 | 0.320 |
| 2-10 Invention | (3) | 0.224 | 0.307 | 0.309 |
| 2-11 Invention | (4) | 0.274 | 0.319 | 0.323 |
| 2-12 Invention | (5) | 0.247 | 0.306 | 0.317 |

As the data in TABLE 2 show, samples in which compounds (1)–(5) of the invention are included in the interlayer (2-8, -9, -10, -11, -12) produced much lower G Delta values than the control containing no scavenger (2-1), the sample containing the commonly employed scavenger di-t-octylhydroquinone, and those ***containing unballasted naphtholic couplers having unballasted coupling-off moieties (2-6, -7). Control elements containing the ballasted disulfonamidophenol (2-2) or those containing ballasted naphtholic couplers with unballasted coupling-off moieties (2-4, -5) exhibited good scavenging activity. However these latter three control compounds also produced substantial non-imagewise stain and/or cyan dye density, as evidenced by their considerably higher (R@E-min) and R D-max values compared with elements of the invention.

EXAMPLE 3

D-min Control by Oxidized Developer-scavenging Couplers

Photographic elements were prepared using a cellulose acetate-butyrate film support provided with Rem-Jet antihalation backing. On the support were coated the following layers:

a layer containing 4.89 g/m$^2$ of gelatin;

a photosensitive layer containing 0.81 g/m$^2$ of a green-sensitized silver iodobromide emulsion, 0.28 g/m$^2$ of magenta image dye-forming coupler M-2, and 5.4 mmoles/cm$^2$ of an oxidized developer-scavenging coupler of the invention or a control compound; and an overcoat layer containing 2.69 g/m$^2$ of gelatin hardened with bis(vinylsulfonylmethyl) ether in an amount 1.75 weight percent of total gelatin.

The samples were exposed and processed as described in Example 2, and measurements were made of G D-min, R D-min, and R D-max. The results of these measurements are shown in TABLE 3 below:

TABLE 3

| Sample | Scavenger | G D-min | R D-min | R D-max |
|---|---|---|---|---|
| 3-1 Control | None | 0.200 | 0.039 | 0.083 |
| 3-2 Control | C-1 | 0.170 | 0.041 | 0.137 |
| 3-3 Invention | (1) | 0.142 | 0.037 | 0.084 |
| 3-4 Invention | (4) | 0.147 | 0.037 | 0.089 |

Compared with the control sample containing no scavenger (3-1), the elements containing oxidized developer-scavenging couplers in accordance with the invention (3-3, -4) produced substantially reduced values of G D-min, with essentially no changes in red density at either minimum or maximum exposure. Including the ballasted naphthol cyan dye-forming coupler C-1 as a scavenger (3-2) produced some lowering of G D-min, but, in contrast to the results obtained with elements of the invention (3-3, -4), there was a substantial increase in R D-max. Thus, the oxidized developer-scavenging couplers of the present invention, when incorporated in a photosensitive layer, provide beneficial control of minimum density within that layer without attendant generation of undesired cyan dye density or other stains.

EXAMPLE 4

Processing of Multilayer Color Photographic Element Containing Oxidized Developer-scavenging Coupler Photographic sample 4-1 (comparative control) was prepared by applying the following layers in the given sequence to a transparent support of cellulose triacetate. The side of the support to be coated had been prepared by the application of gelatin subbing. The quantities of silver halide are given in grams of silver/m$^2$. The quantities of other materials are given in g/m$^2$.

Layer 1: Antihalation Layer

| | |
|---|---|
| Black colloidal silver sol | 0.151 |
| UV-1 | 0.075 |
| UV-2 | 0.075 |
| Oxidized developer scavenger CS-2 | 0.108 |
| Compensatory printing density cyan dye CD-1 | 0.020 |
| Compensatory printing density yellow dye MM-1 | 0.088 |
| HBS-1 | 0.082 |
| HBS-2 | 0.174 |
| HBS-5 | 0.151 |
| Disodium salt of 3,5-disulfocatechol | 0.270 |
| Gelatin | 2.044 |

Layer 2: Low Sensitivity Red-Light Sensitive Layer

This layer comprised a blend of a lower sensitivity, red-sensitized tabular silver iodobromide emulsion [1.3% iodide, average grain diameter 0.53 micrometers and thickness 0.09 micrometers] and a higher sensitivity, red-sensitized tabular silver iodobromide emulsion [4.1% iodide, average grain diameter 1.04 micrometers and thickness 0.09 micrometers].

| | |
|---|---|
| Lower sensitivity emulsion | 0.409 |
| Higher sensitivity emulsion | 0.441 |
| Bleach accelerator coupler B-1 | 0.038 |
| Cyan dye forming coupler C-2 | 0.538 |
| Cyan dye forming magenta colored coupler CM-1 | 0.027 |
| Oxidized developer scavenger S-1 | 0.010 |

-continued

| | |
|---|---|
| HBS-2 | 0.538 |
| HBS-3 | 0.038 |
| TAI | 0.015 |
| Gelatin | 1.775 |

Layer 3: Medium Sensitivity Red-Light Sensitive Layer
Red-sensitized tabular silver iodobromide emulsion [4.1 mol % iodide, average grain diameter 1.39 micrometers and thickness 0.12 micrometers].

| | |
|---|---|
| Emulsion | 0.700 |
| DIR coupler D-1 | 0.011 |
| Cyan dye forming magenta colored coupler CM-1 | 0.022 |
| Cyan dye forming coupler C-2 | 0.226 |
| HBS-2 | 0.226 |
| HBS-4 | 0.022 |
| TAI | 0.011 |
| Gelatin | 1.614 |

Layer 4: High Sensitivity Red-Light Sensitive Layer
Red-sensitized, tabular silver iodobromide emulsion [4.1 mol % iodide, average grain diameter 2.93 micrometers and thickness 0.13 micrometers].

| | |
|---|---|
| Emulsion | 1.076 |
| DIR coupler D-1 | 0.020 |
| DIR coupler D-2 | 0.048 |
| Cyan dye forming magenta colored coupler CM-1 | 0.032 |
| Cyan dye forming coupler C-2 | 0.144 |
| HBS-1 | 0.194 |
| HBS-2 | 0.144 |
| HBS-4 | 0.041 |
| TAI | 0.018 |
| Gelatin | 1.410 |

Layer 5: Interlayer

| | |
|---|---|
| Gelatin | 0.592 |

Layer 6: Low Sensitivity Green-Light Sensitive Layer
This layer comprised a blend of lower sensitivity, green-sensitized tabular silver iodobromide emulsion [1.3 mol % iodide, average grain diameter 0.55 micrometers and thickness 0.09 micrometers] and higher sensitivity, green-sensitized tabular silver iodobromide emulsion [4.1 mol % iodide, average grain diameter 1.08 micrometers and thickness 0.09 micrometers].

| | |
|---|---|
| Lower sensitivity emulsion | 0.538 |
| Higher sensitivity emulsion | 0.280 |
| Magenta dye forming yellow colored coupler MM-2 | 0.065 |
| Magenta dye forming coupler M-2 | 0.355 |
| Oxidized developer scavenger S-1 | 0.021 |
| HBS-1 | 0.414 |
| TAI | 0.013 |
| Gelatin | 1.723 |

Layer 7: Medium Sensitivity Green-Light Sensitive Layer
Green-sensitized tabular silver iodobromide emulsion [4.1 mol % iodide, average grain diameter 1.23 micrometers and thickness 0.12 micrometers].

| | |
|---|---|
| Emulsion | 0.969 |
| DIR coupler D-1 | 0.024 |

-continued

| | |
|---|---|
| Magenta dye forming yellow colored coupler MM-2 | 0.065 |
| Magenta dye forming coupler M-2 | 0.081 |
| Oxidized developer scavenger S-1 | 0.019 |
| HBS-1 | 0.194 |
| HBS-4 | 0.048 |
| TAI | 0.016 |
| Gelatin | 1.399 |

Layer 8: High Sensitivity Green-Light Sensitive Layer
Green-sensitized, tabular silver iodobromide emulsion [4.1 mol % iodide, average grain diameter 2.19 micrometers and thickness 0.13 micrometers].

| | |
|---|---|
| Emulsion | 0.969 |
| DIR coupler D-3 | 0.011 |
| DIR coupler D-4 | 0.011 |
| Magenta dye forming yellow colored coupler MM-2 | 0.054 |
| Magenta dye forming coupler M-2 | 0.062 |
| HBS-1 | 0.179 |
| HBS-2 | 0.011 |
| TAI | 0.012 |
| Gelatin | 1.399 |

Layer 9: Yellow Filter Layer

| | |
|---|---|
| Cary Lea silver | 0.0011 |
| Yellow filter dye YFD-1 | 0.108 |
| Gelatin | 0.592 |

Layer 10: Low Sensitivity Blue-Light Sensitive Layer
This layer comprised a blend of a lower sensitivity, blue-sensitized tabular silver iodobromide emulsion [1.3 mol % iodide, average grain diameter 0.53 micrometers and thickness 0.09 micrometers], and a higher sensitivity, tabular blue-sensitized silver iodobromide emulsion [6.0 mol % iodide, average grain diameter 0.96 micrometers and thickness 0.26 micrometers].

| | |
|---|---|
| Low sensitivity emulsion | 0.247 |
| High sensitivity emulsion | 0.635 |
| DIR coupler D-5 | 0.065 |
| Yellow dye forming coupler Y-2 | 0.280 |
| Yellow dye forming coupler Y-3 | 0.742 |
| Bleach accelerator coupler B-1 | 0.003 |
| Cyan dye forming coupler C-2 | 0.016 |
| Oxidized developer scavenger S-1 | 0.004 |
| HBS-2 | 0.963 |
| HBS-3 | 0.003 |
| TAI | 0.015 |
| Gelatin | 2.615 |

Layer 11: High Sensitivity Blue-Light Sensitive Layer
This layer comprised a blend of lower sensitivity, blue-sensitized silver iodobromide emulsion [9.0 mol % iodide, average grain diameter 1.06 micrometers] and high sensitivity, tabular blue-sensitized silver iodobromide emulsion [4.1 mol % iodide, average grain diameter 3.37 micrometers and thickness 0.14 micrometers]

| | |
|---|---|
| Low sensitivity emulsion | 0.226 |
| High sensitivity emulsion | 0.570 |
| Yellow dye forming coupler Y-2 | 0.070 |
| Yellow dye forming coupler Y-3 | 0.186 |
| DIR coupler D-5 | 0.047 |
| Bleach accelerator coupler B-1 | 0.005 |
| Cyan dye forming coupler C-2 | 0.017 |

-continued

| | |
|---|---|
| Oxidized developer scavenger S-1 | 0.004 |
| HBS-2 | 0.277 |
| HBS-3 | 0.005 |
| TAI | 0.005 |
| Gelatin | 1.926 |

Layer 12: Ultraviolet Filter Layer

| | |
|---|---|
| Dye UV-1 | 0.108 |
| Dye UV-2 | 0.108 |
| Unsensitized silver bromide Lippinann emulsion | 0.215 |
| HBS-5 | 0.216 |
| Gelatin | 0.699 |

Layer 13: Protective Overcoat Layer

| | |
|---|---|
| Polymethylmethacrylate matte beads | 0.005 |
| Soluble polymethylmethaerylate matte beads | 0.054 |
| Silicone lubricant | 0.039 |
| Gelatin | 0.882 |

This film was hardened at the time of coating with 1.75% by weight of total gelatin of hardener H-1. Surfactants, coating aids, soluble absorber dyes, antifoggants, stabilizers, antistatic agents, biostats, biocides, and other addenda chemicals were added to the various layers of this sample as is commonly practiced in the art.

Sample 4-2 (comparative control) color photographic recording material for color negative development was prepared exactly as above in sample 4-1, except where noted below.

Layer 5: Interlayer Changes

| | |
|---|---|
| CS-2 | 0.065 |
| HBS-2 | 0.105 |

Layer 9: Yellow Filter Layer Changes

| | |
|---|---|
| CS-2 | 0.065 |
| HBS-2 | 0.105 |

Sample 4-3 (comparative control) color photographic recording material for color negative development was prepared exactly as above in sample 4-1, except where noted below.

Layer 5: Interlayer Changes

| | |
|---|---|
| CS-7 | 0.149 |
| HBS-6 | 0.298 |

Layer 9: Yellow Filter Layer Changes

| | |
|---|---|
| CS-7 | 0.149 |
| HBS-6 | 0.298 |

Sample 4-4 (comparative control) color photographic recording material for color-negative development was prepared exactly as above in sample 4-1, except where noted below.

Layer 5: Interlayer Changes

| | |
|---|---|
| CS-6 | 0.079 |
| HBS-6 | 0.157 |

Layer 9: Yellow Filter Layer Changes

| | |
|---|---|
| CS-6 | 0.079 |
| HBS-6 | 0.157 |

Sample 4-5 (invention) color photographic recording material for color negative development was prepared exactly as above in sample 4-1, except where noted below.

Layer 5: Interlayer Changes

| | |
|---|---|
| Oxidized developer scavenger (1) | 0.119 |
| HBS-6 | 0.119 |

Layer 9: Yellow Filter Layer Changes

| | |
|---|---|
| Oxidized developer scavenger (1) | 0.119 |
| HBS-6 | 0.119 |

Sample 4-6 (invention) color photographic recording material for color negative development was prepared exactly as above in sample 4-1, except where noted below.

Layer 5: Interlayer Changes

| | |
|---|---|
| Oxidized Developer Scavenger (4) | 0.121 |
| HBS-6 | 0.243 |

Layer 9: Yellow Filter Layer Changes

| | |
|---|---|
| Oxidized developer scavenger (4) | 0.121 |
| HBS-6 | 0.243 |

Sample 4-7 (invention) color photographic recording material for color negative development was prepared exactly as above in sample 4-1, except where noted below.

Layer 5: Interlayer Changes

| | |
|---|---|
| Oxidized developer scavenger (3) | 0.126 |
| HBS-6 | 0.252 |

Layer 9: Yellow Filter Layer Changes

| | |
|---|---|
| Oxidized developer scavenger (3) | 0.126 |
| HBS-6 | 0.252 |

Sample 4-8 (comparative control) color photographic recording material for color negative development was prepared exactly as above in sample 4-1, except where noted below.

Layer 1: Antihalation Layer Changes

| | |
|---|---|
| Oxidized developer scavenger CS-2 | 0.0 |
| HBS-2 | 0.0 |

Sample 4-9 (invention) color photographic recording material for color negative development was prepared exactly as above in sample 4-8, except where noted below.

Layer 1: Antihalation Layer Changes

| | |
|---|---|
| Oxidized developer scavenger (1) | 0.197 |
| HBS-6 | 0.197 |

Sample 4-10 (invention) color photographic recording material for color negative development was prepared exactly as above in sample 4-8, except where noted below.

Layer 1: Antihalation Layer Changes

| | |
|---|---|
| Oxidized developer scavenger (4) | 0.202 |
| HBS-6 | 0.404 |

Sample 4-11 (invention) color photographic recording material for color negative development was prepared exactly as above in sample 4-1, except where noted below.

Layer 4: High Sensitivity Red-Light Sensitive Layer Changes

| | |
|---|---|
| Oxidized developer scavenger (1) | 0.038 |
| HBS-6 | 0.038 |

Layer 8: High Sensitivity Green-Light Sensitive Layer Changes

| | |
|---|---|
| Oxidized developer scavenger (1) | 0.038 |
| HBS-6 | 0.038 |

Sample 4-12 (invention) color photographic recording material for color negative development was prepared exactly as above in sample 4-1, except where noted below.

Layer 4: High Sensitivity Red-Light Sensitive Layer Changes

| | |
|---|---|
| Oxidized developer scavenger (4) | 0.041 |
| HBS-6 | 0.082 |

Layer 8: High Sensitivity Green-Light Sensitive Layer Changes

| | |
|---|---|
| Oxidized developer scavenger (4) | 0.041 |
| HBS-6 | 0.082 |

UV-1

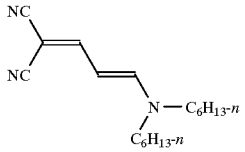

UV-2

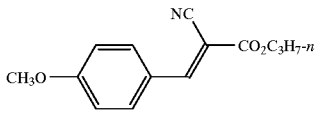

-continued

MM-1

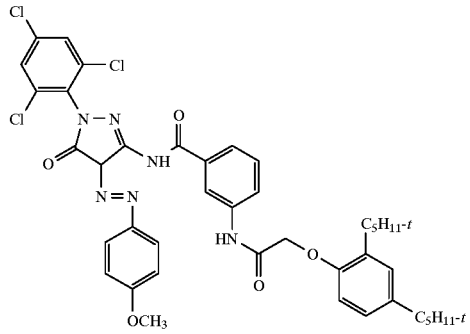

MM-2

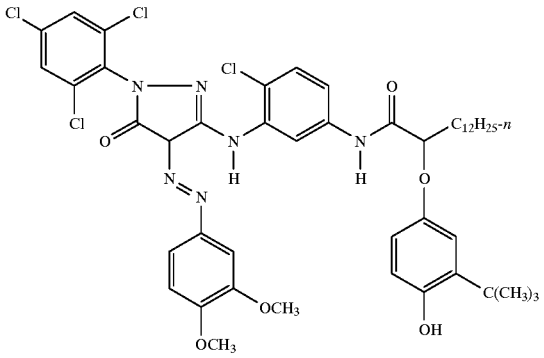

CD-1

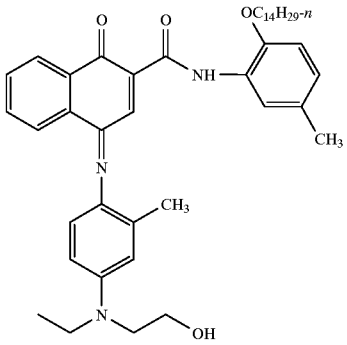

Y-3

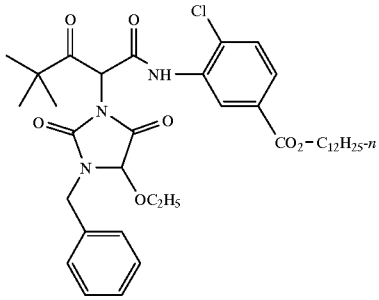

-continued
Y-2
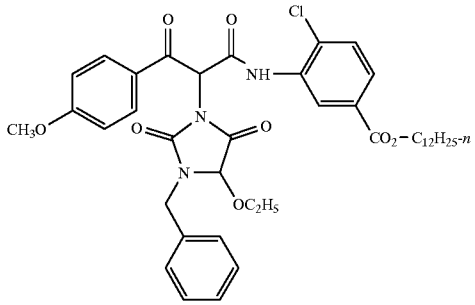
YFD-1
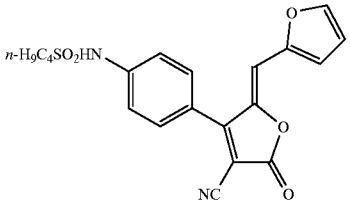
C-2
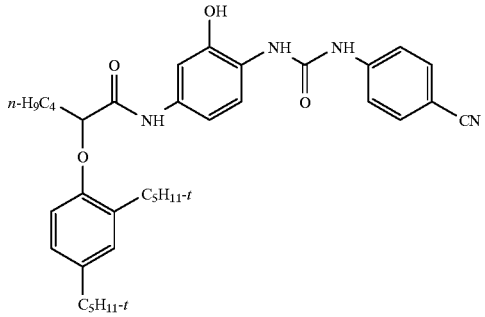
B-1
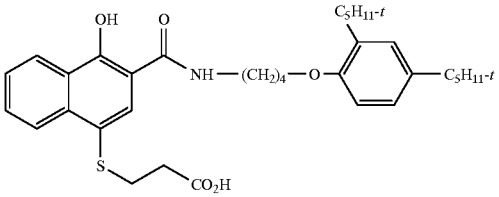
CM-1
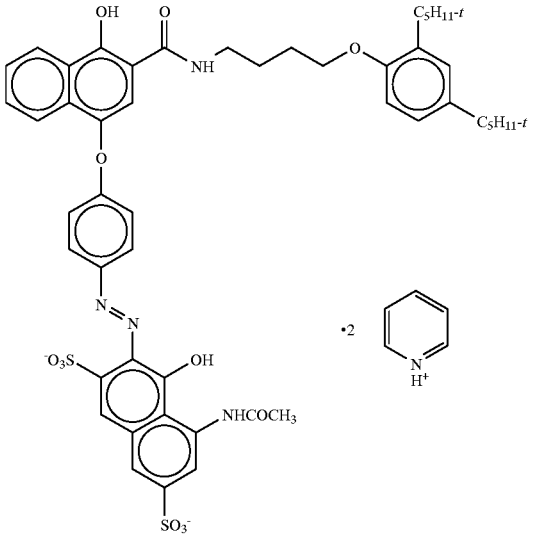
-continued
D-2
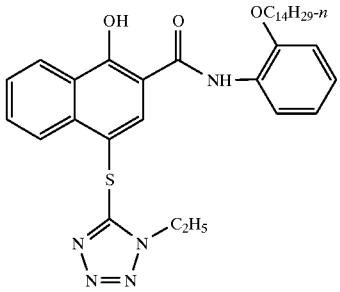
D-1
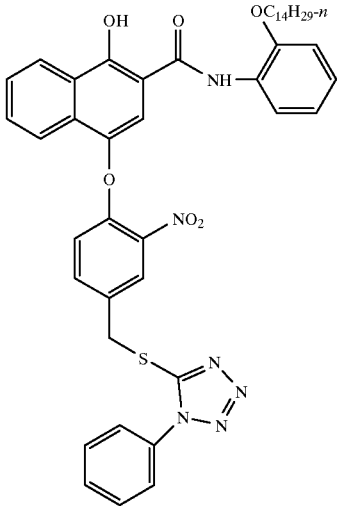
D-3
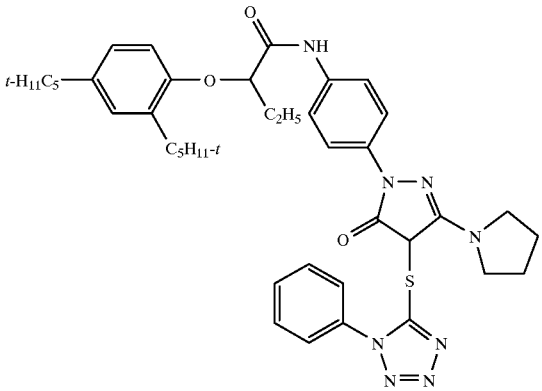
D-4
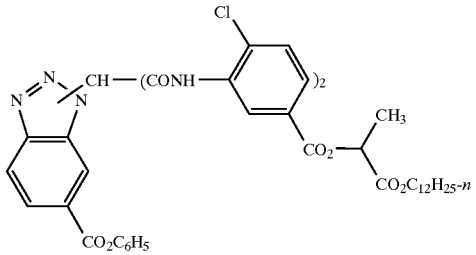

-continued

D-5

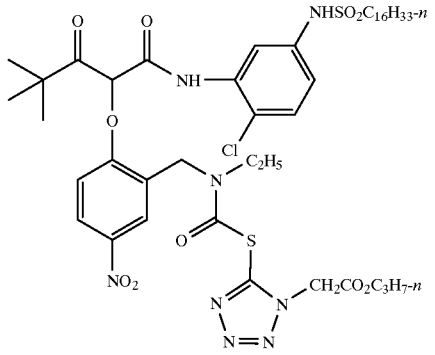

S-1

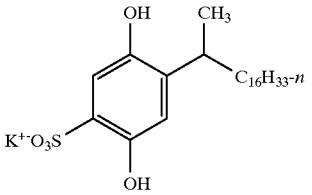

Photographic recording materials Samples 4-1 to 4-12 were individually exposed for 1/500 of a second to white light from a tungsten light source of 3200 K color temperature that was filtered by a Daylight Va filter to 5500 K through a graduated 0–4.0 density step tablet to determine their speed and gamma. The samples were then processed using the KODAK Process C-41, as described in *British Journal of Photography Annual,* 1988, pp. 196–198, with fresh, unseasoned processing chemical solutions. Another description of the use of the C-41 or FLEXICOLOR Process can be found in "Using Kodak Flexicolor Chemicals", Publication Z-131, Eastman Kodak Company, Rochester, N.Y. (Kodak is a trademark of the Eastman Kodak Company, U. S. A.). In addition, a set of unexposed Samples 4-1 to 4-12 were subjected to a variation of the Flexicolor processing steps to determine the residual minimum density of the samples associated with the colored masking couplers and stains, wherein the samples were bleached, water-washed, fixed, water-washed, developed, bleached, water-washed, fixed, water-washed, and stabilized using the same FLEXICOLOR Process chemical solutions at their respective usual times.

Following processing and drying, Samples 4-1 to 4-12 were subjected to Status M densitometry and their sensitometric performance was characterized. The recording material granularity was determined by scanning the samples with a microdensitometer employing a 48-micrometer aperture.

The photographic performance of the green-light sensitive unit of the photographic recording material samples 4-1 to 4-7 was found to be generally representative of the behavior of the other units of those materials. The effect of interlayer oxidized developer scavenging compound on white light exposure performance of the green-light sensitive color unit is shown in TABLE 4. The relative speed was determined by normalizing the IR speed (the exposure at 0.15 density above $D_{min}$ (base+fog+residual dye density) in units of 100*log (lux-s)) to the value of control sample 4-1. The net fog density was determined by subtracting the residual minimum density from the normal color negative process minimum density. The gamma value was determined from the low-midscale region slope of the sample's characteristic curve for the reported color unit.

TABLE 4

| Sample | Interlayer Scavenger | Red Unit Net Fog Density | Green Unit Net Fog Density | Relative Green Unit Speed | Green Unit Gamma |
|---|---|---|---|---|---|
| 4-1 Control | None | 0.13 | 0.24 | 0 | 0.66 |
| 4-2 Control | CS-2 | 0.12 | 0.19 | 2 | 0.64 |
| 4-3 Control | CS-7 | 0.11 | 0.13 | −20 | 0.60 |
| 4-4 Controi | CS-6 | 0.11 | 0.19 | −7 | 0.62 |
| 4-5 Invention | (1) | 0.11 | 0.16 | −1 | 0.65 |
| 4-6 Invention | (4) | 0.13 | 0.17 | −3 | 0.64 |
| 4-7 Invention | (3) | 0.11 | 0.15 | 3 | 0.65 |

The data for comparative control samples 4-1 and 4-2 illustrate the effect of placement of the common interlayer oxidized developer scavenging compound CS-2 in the two interlayers between the color units. The green-light sensitive color unit fog level can be reduced without significant deleterious effect on its sensitometric performance by the proximity of such a compound, resulting in superior image recording properties. A second comparative control element, 4-3, comprising an unballasted naphtholic coupler moiety with a ballasted sulfonamidophenol coupling off group that releases the PUG 1-phenyl-5-mercaptotetrazole, is shown to also produce reduced green-light sensitive color unit fog without net red density build-up due to retained cyan dye, but the fog reduction is accompanied by a large and undesirable loss of speed. Naphtholic coupler compounds of the art that release PUGs represented by compound CS-6 can achieve the goal of fog suppression but produce unwanted side effects that render them unacceptable. A third comparative control, 4-4, comprising an unballasted naptholic coupler moiety with a substantially unballasted carbonamidophehol coupling off group, reveals that the net fog density of the green-light sensitive color unit can also be reduced by the effective naptholic coupler moiety without net red density build-up due to retained cyan dye, but the functional group size of the aliphatic substituent of the carbonamidophenol coupling off group is insufficient to prevent the compound CS-6 from migrating into the green-light sensitive unit itself, where it causes substantial and undesirable speed and gamma losses.

Scavenger compounds (1), (4), and (3) in samples 4-5 to 4-7 of the invention, which are present in equimolar quantities to the comparative control compounds CS-2, CS-6, and CS-7, are seen in TABLE 4 to beneficially reduce the net fog density of the green-light sensitive color unit without net red density build-up due to retained cyan dye and without significant deleterious reductions in speed and gamma.

The primary desirable effect of an interlayer scavenging compound is to minimize or mitigate entirely the unwanted migration of oxidized developer from one color unit into another color unit. Oxidized developer molecules diffusing across color unit interlayer boundaries can couple with image dye precursors that form different primary color dyes from the color unit of origination to form the incorrect image dye in an imagewise fashion and thus undermine desirable interlayer interimage effects. Such desirable interlayer interimage effects that result in imagewise suppression of development or density formation produce color correction for the unwanted absorptions of the image dyes in both the color negative image recording material and the color paper photographic display material, and this color correction ultimately gives more colorful, accurate, and pleasing color renditions of the original scene that was photographed.

Photographic samples 4-1 to 4-7 were subjected to an imagewise stepped red- light exposure for 1/50 of a second from a tungsten light source at 2850 K filtered through a KODAK WRATTEN Gelatin Filter No. 23A, and then were subjected to two non-imagewise flash exposures differing by 0.8 neutral density (producing lower scale and midscale equivalent exposures) for 1/50 of a second to white light from the tungsten source filtered through each of a WRATTEN Gelatin Filter No. 98 and an Andover Corp. 550-nm interference filter. A second set of photographic samples 4-1 to 4-7 were subjected to an imagewise stepped green-light exposure for 1/50 of a second from a tungsten light source at 2850 K filtered through a 550-nm interference filter, and then were subjected to two non-imagewise flash exposures differing by 0.8 neutral density (producing lower scale and midscale equivalent exposures) for 1/50 of a second to white light from the tungsten source filtered through each of a WRATTEN Gelatin Filter No. 98 and a WRATTEN Gelatin Filter No. 23A. Process C-41 processing of all of the samples was carried out, and the Status M density response was determined.

The relative magnitude of two important interlayer interimage effect terms was gauged by determining the magnitude of the difference between the maximum and minimum flash exposure density for each of the lower scale and midscale equivalent exposures produced in an imagewise fashion by the stepped exposure. A larger magnitude of flash exposure density change reveals a higher, desirable interlayer interimage effect produced by the imagewise separation stepped exposure of the causing color unit. The effect of interlayer oxidized developer scavenging compound on the red-color separation exposure imagewise density suppression of the green light-sensitive color unit's flash exposure density response, and the green-color separation exposure imagewise density suppression of the blue light-sensitive color unit's flash exposure density response, are both reported in TABLE 5.

TABLE 5

| | | Red-Stepped Exposure | | Green-Stepped Exposure | |
|---|---|---|---|---|---|
| Sample | Interlayer Scavenger | Low Exp. Green Density Change | Mid Exp. Green Density Change | Low Exp. Blue Density Change | Mid Exp. Blue Density Change |
| 4-1 Control | None | 0.09 | 0.19 | 0.17 | 0.35 |
| 4-2 Control | CS-2 | 0.15 | 0.27 | 0.24 | 0.43 |
| 4-3 Control | CS-7 | 0.12 | 0.24 | 0.30 | 0.47 |
| 4-4 Control | CS-6 | 0.10 | 0.23 | 0.22 | 0.34 |
| 4-5 Invention | (1) | 0.14 | 0.27 | 0.25 | 0.40 |
| 4-6 Invention | (4) | 0.15 | 0.28 | 0.24 | 0.41 |
| 4-7 Invention | (3) | 0.15 | 0.26 | 0.25 | 0.42 |

The data for comparative control samples 4-1 to 4-2 again show the effect of placement of the common interlayer oxidized developer scavenging compound CS-2 in the two interlayers between the color units. The marked increase in the magnitude of the imagewise density suppression of the flash-exposed color units by step-exposed color units in the presence of CS-2 suggests that oxidized developer readily diffused across the interlayers separating the color units, and it adulterated the desirable interlayer interimage effects by reacting with the wrong color unit's image dye-forming couplers to create the incorrect dye. The comparative control element, 4-3, comprising an unballasted naphtholic coupler moiety with a ballasted sulfonamidophenol coupling off group that releases the PUG 1-phenyl-5-mercaptotetrazole, also produced desirable increases in the flash exposure density suppression of the interimage receiving layers. However, the increased interlayer interimage effects were accompanied by a large and undesirable loss of speed in the neutral exposure as reported earlier. PUG-releasing, unballasted naphtholic coupler moiety compounds cannot be relied upon to yield improved interlayer interimage effects without attendant undesirable side effects. The third comparative control, 4-4, comprising an unballasted naphtholic coupler moiety with a substantially unballasted carbonamidophenol coupling off group, showed lower effectiveness in reducing color unit contamination by oxidized developer migration since the compound itself was not well spatially fixed in the interlayer due to the inadequate ballasting performance of the aliphatic substituent of the carbonamidophenol coupling off group. It should be recalled that sample 4-4 comprising compound CS-6 showed substantial and undesirable speed and gamma losses in the neutral exposure performance data reported in TABLE 4.

The examples 4-5 to 4-7, of the invention, comprising compounds (1), (4), and (3) in equimolar quantities to the comparative control compounds CS-2, CS-6, and CS-7, produced comparable increases in the magnitude of the imagewise density suppression over the control sample 4-1 which did not contain an interlayer scavenging compound. Furthermore, compounds (1), (4), and (3) did not produce significant undesirable reductions in speed and gamma of the neutral exposure characteristic curve as described earlier.

TABLE 6 reports the effect of oxidized developer scavenger compounds in the antihalation undercoat on the red light-sensitive color unit's minimum density following a white light exposure, C-4 1 processing, and determination of the Status M densitometry as described earlier. And the net fog level resulting from that minimum density less the residual minimum density due to stains and dyes is also included.

TABLE 6

| Sample | Oxidized Developer Scavenger | Red Minimum Density | Residual Minimum Density | Net Fog Density |
|---|---|---|---|---|
| 4-8 Control | None | 0.349 | 0.177 | 0.17 |
| 4-1 Control | CS-2 | 0.289 | 0.160 | 0.13 |
| 4-9 Invention | (1) | 0.306 | 0.177 | 0.13 |
| 4-10 Invention | (4) | 0.329 | 0.176 | 0.15 |

The reduction in net fog density by the presence of an antihalation layer oxidized developer scavenging compound is exemplified by comparison of the control sample 4-1 comprising the common aliphatic group-substituted 1,4-benzenediol, CS-2, and 4-8 which lacks any scavenging compound. While there was no appreciable effect on the residual red minimum density from the scavenging compound, its presence reduced the minimum density and the net fog level by about 0.04 density, which is a meaningful and desirable improvement. Finely particulate metals such as the filamentary silver comprising black colloidal silver sols used for antihalation protection or the yellow Cary Lea silver used in yellow filter layers to mitigate unwanted blue-light sensitivity of the green-light sensitive color unit are capable of producing fog by either direct contact with silver halide emulsion grains at the interface of layers or by solution physical development processes. In the latter mechanism, soluble silver ion is reduced by developer molecules at the metal particle in a non-imagewise fashion, and the oxidized developer molecules may wander into coupler-containing layers and undesirably form dye, wasting the coupler compound and increasing the difficulty of correctly and efficiently printing the color negative image onto color paper. The color photographic recording materials, 4-9 and 4-10 of the invention, comprising equimolar quantities of compounds (1) and (4), respectively, to common comparative compound CS-2 of element 4-1, both demonstrated comparable and beneficial net fog density reduction.

The effect of oxidized developer scavenging compound included in the fast green light-sensitive emulsion layer on the color unit's minimum density and fog level is contained in TABLE 7. Samples 4-11 and 4-12 of the invention, comprising compounds (1) and (4), respectively, showed appreciably reduced minimum density and net fog density over comparative control 4-1 that lacked a fast green-light sensitive layer scavenger. The reduction in fog density in turn produced lower granularity in the minimum density region of the exposed and processed photographic recording materials, and it even contributed to increased lower scale characteristic curve gamma. Thus the underexposure region signal-to-noise ratio of the two recording materials of the invention was quite improved over that of the control.

TABLE 7

| Sample | Oxidized Developer Scavenger | Minimum Density | Net Fog Density | Granularity at Min. Density | Gamma in Lower Scale |
|---|---|---|---|---|---|
| 4-1 Control | None | 0.748 | 0.24 | 0.0165 | 0.53 |
| 4-11 Invention | (1) | 0.705 | 0.20 | 0.0150 | 0.57 |
| 4-12 Invention | (4) | 0.725 | 0.21 | 0.0152 | 0.55 |

It should also be appreciated that the benefits in photographic performance conferred by the inclusion of Compounds (1), (3), and (4) in the examples of the invention will probably be amplified over the comparative control examples of the art comprising compounds such as CS-2 and S-1 in other circumstances. The fundamentally different mechanism of operation of oxidized developer scavenging compounds based on unballasted naphtholic coupler moieties can lead to high scavenging compound stability and robustness under other conditions of usage or aging. It is appreciated by practitioners of this art that oxidized developer scavenger compounds that function via electron transfer in chemical mechanisms involving reduction and oxidation processes can be susceptible to aerial oxidation during the storage of the photographic recording material over its normal lifetime. Photographic dispersion preparations of CS-2 in HBS-2 are particularly prone to destruction by aerial oxidation which can result in the failure of interlayers comprising it and limit the otherwise useful recording material shelf-life. Naphtholic coupler moieties are not known to suffer aerial oxidation. Also, color reversal recording materials are subjected to a first black-and-white development step with hydroquinone-based developer, followed ultimately by a second development to completion of the residual silver halide emulsion (not reduced to silver during first development) by a typical color developer. Thus in color reversal systems, 1,4-dihydroxybenzene or hydroquinone-based scavenging compounds in interlayers are again susceptible to destruction in a preliminary stage of the image forming process rendering them useless for preventing color contamination at the time of color development where their effect is required. Naphtholic coupler moieties are not known to undergo reactions with quinone-type black-and-white first developer by-products that would leave them ineffective for coupling with oxidized color developer molecules in a later step of the color reversal process.

As shown by the illustrative examples, the developer-scavenging naphtholic coupler can be located in a photographic silver halide emulsion layer, which can further include a coupler compound capable of forming a dye that remains in the layer following photographic processing. Alternatively, the naphtholic coupler can be situated in a radiation-insensitive interlayer located either between two radiation-sensitive photographic layers or between a photographic layer and the film support. Thus, the naphtholic coupler can be in reactive association with a silver halide emulsion layer by incorporation either in that layer or in an adjacent radiation-insensitive layer. Radiation-sensitive layers in the color photographic element of the invention can further include compounds that release a photographically useful group (PUG) such as, for example, a development inhibitor releasing coupler or a bleach accelerator-releasing coupler.

The invention has been described in detail with particular reference to preferred embodiments thereof, but it will be understood that variations and modifications can be effected within the spirit and scope of the invention.

What is claimed is:

1. A color photographic element comprising:

a film support;

at least one radiation-sensitive layer containing a silver halide photographic emulsion; and a naphtholic coupler that is substantially immobilized in said element and comprises a dye-forming moiety and a ballasted, substantially photographically inert coupling-off moiety, said coupler having the structure

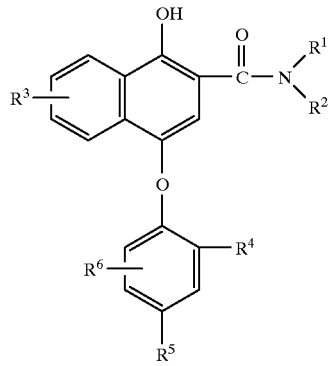

wherein $R^1$ and $R^2$ each independently represents hydrogen, an alkyl group, an alkoxyalkyl group, or a hydroxyalkyl group, $R^1$ and $R^2$ together containing a total of up to 4 carbon atoms;

$R^3$ represents hydrogen, halo, or an alkoxy, an alkylcarbonamido, an alkylsulfonamido, a carbamoyl, or a sulfamoyl group containing up to 4 carbon atoms, $R^1$, $R^2$, and $R^3$ each being devoid of alkali-solubilizing groups, and $R^1$, $R^2$, and $R^3$ together allowing substantially complete removal during photographic processing of the dye formed by said coupler;

$R^4$, $R^5$ and $R^6$ represent substituent groups that together comprise ballast sufficient to substantially immobilize said naphtholic coupler in said photographic element and together render said coupling-off moiety substantially photographically inert, at least one of said $R^4$, $R^5$ and $R^6$ comprising at least 8 carbon atoms and $R^5$ being selected from a group of substituent groups effective to substantially prevent formation of dye and/or stain by preventing reaction of said coupling-off moiety with oxidized developer.

2. The color photographic element of claim 1 wherein said naphtholic coupler is included in said radiation-sensitive layer.

3. The color photographic element of claim 2 wherein said radiation-sensitive layer further comprises a dye-forming coupler compound capable of forming a dye that remains in said layer following photographic processing.

4. The color photographic element of claim 3 wherein said radiation-sensitive layer further comprises a compound that releases a photographically useful group.

5. The color photographic element of claim 4 wherein said compound that releases a photographically useful group is selected from the group consisting of a development inhibitor releasing coupler and a bleach accelerator releasing coupler.

6. The color photographic element of claim 1 wherein said naphtholic coupler is located in a radiation-insensitive interlayer disposed between two radiation-sensitive layers containing silver halide photographic emulsions.

7. The color photographic element of claim 6 wherein each of said radiation-sensitive layers further comprises a dye-forming coupler compound capable of forming a dye that remains in each of said radiation-sensitive layers following photographic processing.

8. The color photographic element of claim 7 wherein at least one of said radiation-sensitive layers further comprises a compound that releases a photographically useful group.

9. The color photographic element of claim 8 wherein said compound that releases a photographically useful group is selected from the group consisting of a development inhibitor releasing coupler and a bleach accelerator releasing coupler.

10. The color photographic element of claim 1 wherein said naphtholic coupler is located in a radiation-insensitive layer between a radiation-sensitive layer containing a silver halide photographic emulsion and the film support.

11. The color photographic element of claim 10 wherein said radiation-sensitive layer further comprises a dye forming coupler compound capable of forming a dye that remains in each of said radiation-sensitive layers following photographic processing.

12. The color photographic element of claim 11 wherein said radiation-sensitive layer further comprises a compound that releases a photographically useful group.

13. The color photographic element of claim 12 wherein said compound that releases a photographically useful group is selected from the group consisting of a development inhibitor releasing coupler and a bleach accelerator releasing coupler.

14. The color photographic element of claim 1 wherein $R^1$ is hydrogen and $R^2$ is hydrogen, methyl, ethyl, hydroxyethyl, methoxyethyl, or ethoxyethyl.

15. The color photographic element of claim 14 wherein $R^1$, $R^2$, and $R^3$ are each hydrogen.

16. The color photographic element of claim 1 wherein $R^5$ is selected from the group consisting of an alkyl group, an aryl group, a carbamoyl group, a sulfamoyl group, an alkyl carbonyl group, an arylcarbonyl group, an alkylsulfonyl group, an arylsulfonyl group, an alkylcarbonamido group, an arylcarbonamido group, an alkoxycarbonyl group, an aryloxycarbonyl group, and a ureido group.

17. The color photographic element of claim 16 wherein $R^5$ is selected from the group consisting of an alkyl group, a carbamoyl group, and a sulfamoyl group.

18. The color photographic element of claim 16 wherein $R^4$ and $R^6$ are independently selected from the group consisting of the groups named for $R^5$, hydrogen, a halo substituent, a cyano group, an alkoxy group, an aryloxy group, an alkylthio group, an arylthio group, an alkylsulfonamido group, an arylsulfonamido group, with the proviso that only one of $R^4$ and $R^6$ is an alkylsulfonamido or arylsulfonamido group having hydrogen attached to the sulfonamide nitrogen atom.

19. The color photographic element of claim 18 wherein $R^4$ is selected from the group consisting of an alkylsulfonamido group, an arylsulfonamido group, an alkylcarbonamido group, and an arylcarbonamido group.

20. The color photographic element of claim 19 wherein $R^4$ comprises ballast sufficient to substantially immobilize said coupler in said photographic element.

21. The color photographic element of claim 20 wherein $R^4$ is a hexadecanesulfonamido group or a p-dodecyloxybenzenesulfonamido group.

22.The color photographic element of claim 18 wherein $R^6$ is hydrogen, $R^5$ is a hydroxymethyl group, and $R^4$ is an alkylsulfonamido group, an arylsulfonamido group, an alkylcarbonamido group, or an arylcarbonamido group comprising ballast sufficient to substantially immobilize said couple in said photographic element.

23. The color photographic element of claim 1 comprising:

a film support;

at least one red-sensitive photographic silver halide emulsion layer comprising at least one cyan image dye-forming coupler;

at least one green-sensitive photographic silver halide emulsion layer comprising at least one magenta image dye-forming coupler; and at least one blue-sensitive photographic silver halide emulsion layer comprising at least one yellow image dye-forming coupler;

wherein said naphtholic coupler is in reactive association with at least one of said photographic silver halide emulsion layers.

24. A process for forming an image in the color photographic element of claim 1, comprising:

exposing said photographic element; and developing the exposed photographic element with a composition comprising a color photographic silver halide developing agent.

* * * * *